US006278850B1

(12) United States Patent
Park

(10) Patent No.: US 6,278,850 B1
(45) Date of Patent: Aug. 21, 2001

(54) DEVICE OF MEASURING CONCENTRATION OF DEVELOPER LIQUID FOR LIQUID-TYPE PRINTER

(75) Inventor: Geun-yong Park, Suwon (KR)

(73) Assignee: Samsung Electronics Co., Ltd., Kyungki-do (KR)

( * ) Notice: Subject to any disclaimer, the term of this patent is extended or adjusted under 35 U.S.C. 154(b) by 0 days.

(21) Appl. No.: 09/473,135

(22) Filed: Dec. 28, 1999

(30) Foreign Application Priority Data

Dec. 28, 1998 (KR) ..... 98-59401

(51) Int. Cl.[7] ..... G03G 15/10
(52) U.S. Cl. ..... 399/57; 118/689; 399/64
(58) Field of Search ..... 399/57, 58, 62, 399/64, 27, 30, 237; 324/71.1; 118/688, 689, 690, 691

(56) References Cited

U.S. PATENT DOCUMENTS

| | | | | |
|---|---|---|---|---|
| 3,789,794 | * | 2/1974 | Smith et al. | 399/57 |
| 4,204,766 | * | 5/1980 | Harada | 399/57 X |
| 5,933,685 | * | 8/1999 | Yoo | 399/57 |
| 6,091,914 | * | 7/2000 | Yoo | 399/57 |

FOREIGN PATENT DOCUMENTS

| | | | | |
|---|---|---|---|---|
| 48-8301 | | 3/1973 | (JP) | G01N/21/02 |
| 49-66351 | | 6/1974 | (JP) | 6773/23 |
| 56-10233 | | 2/1981 | (JP) | G01N/21/59 |
| 5-332926 | * | 12/1993 | (JP) . | |
| 8-128898 | | 5/1996 | (JP) | G01J/3/50 |

* cited by examiner

*Primary Examiner*—Sophia S. Chen
(74) *Attorney, Agent, or Firm*—Sughrue, Mion, Zinn, Macpeak & Seas, PLLC

(57) ABSTRACT

A device for measuring the concentration of a developer liquid for a liquid-type printer, including a container having a discharge portion, first and second rotary members rotatably installed in the container with a predetermined space, and a supply portion for supplying the developer liquid containing toner particles and liquid carrier into the space between the first and second rotary members. A concentration detector is provided for detecting the concentration of the developer liquid by emitting light onto the developer liquid flowing along the space between the first and second rotary members, and receiving the light passed through the developer liquid. In the concentration measuring device, the space between the first and second rotary members can be adjusted to be smaller, and the concentration of a developer liquid having a low light transmittance can also be measured.

1 Claim, 3 Drawing Sheets

DEVICE OF MEASURING CONCENTRATION OF DEVELOPER LIQUID FOR LIQUID-TYPE PRINTER

BACKGROUND OF THE INVENTION

1. Field of the Invention

The present invention relates to a device of measuring the concentration of a developer liquid used in a liquid-type printer, which can sense the concentration of a developer liquid by measuring light transmittance.

2. Description of the Related Art

In liquid electrophotographic printers such as liquid-type laser printers, a latent electrostatic image is formed on a photosensitive medium by scanning laser beams thereunto, and then developed by a developer unit using a developer liquid containing toners having a predetermined color. The resultant toner image is transferred on a print paper, resulting in a color image on the print paper. Such liquid electrophotographic printers need a device of measuring the concentration of a developer liquid, to maintain the concentration of the developer liquid supplied to the photosensitive medium within a predetermined range.

Referring to FIG. 1, a conventional device of measuring the concentration of a developer liquid is disposed on a developer liquid supply pathway, which includes a pair of transparent members 1 and 3 along the space of which a developer liquid D flows, and a light emitting device 5 and a light receiving device 7 facing each other while the pair of transparent members 1 and 3 are interposed therebetween. Thus, in measuring the developer liquid, the light receiving device 7 detects the concentration of a developer liquid by receiving light passed through the developer liquid D after being emitted from the light emitting device 5.

In a concentration measuring device having the above configuration, when a developer liquid D is black, which has a relatively low light transmittance compared to other colors, the transparent members 1 and 3 must be spaced by approximately 0.1 mm or less to detect a difference in light transmittance according to the concentration of the developer liquid D. However, as the space between the transparent members 1 and 3 becomes narrow, the flow rate of the developer liquid becomes slow. Accordingly, toner particles stick to the inner walls of the transparent members 1 and 3, thereby lowering light transmittance. Furthermore, it is not possible to remove the toner particles from the inner walls of the transparent members 1 and 3.

SUMMARY OF THE INVENTION

It is an object of the present invention to provide an apparatus for measuring the concentration of a developer liquid for a liquid-type electrophotographic printer, in which sticking of toner particles to the inner walls of a developer liquid pathway can be prevented although the developer liquid pathway is narrow, so that the concentration of a developer liquid having a low light transmittance can also be measured.

In an aspect of the present invention, there is provided a device of measuring the concentration of developer liquid for a liquid-type printer, comprising: a container having a discharge portion; first and second rotary members rotatably installed in the container with a predetermined space; a supply portion for supplying the developer liquid containing toner particles and liquid carrier into the space between the first and second rotary members; and a concentration detector for detecting the concentration of the developer liquid by emitting light onto the developer liquid flowing along the space between the first and second rotary members, and receiving the light passed through the developer liquid.

In one embodiment, the concentration detector comprises: transparent members formed at at least parts of the first and second rotary members; a light source installed in the first rotary member, for emitting light toward the second rotary member; and a photodetector installed in the second rotary member, facing the light source installed in the first rotary member, for detecting the light emitted from the light source and passed through the developer liquid flowing along the space between the first and second rotary members.

In another embodiment, the concentration detector comprises: a reflection member formed at at least a part of the surface of the first rotary member; a transparent member formed at at least a part of the second rotary member, corresponding to the reflection member; a light source installed in the second rotary member, for emitting light toward the transparent member; and a photodetector installed near the light source in the second rotary member, for receiving the light reflected by the reflection member, which has been emitted from the light source and passed through the developer liquid flowing along the space between the first and second rotary members.

Preferably, the concentration measuring device further comprises a cleaning member installed in contact with the first and/or second rotary members, for removing toner particles stuck to the surface of the first and/or second rotary members with the rotation of the first and/or rotary members.

BRIEF DESCRIPTION OF THE DRAWINGS

The above objects and advantages of the present invention will become more apparent by describing in detail preferred embodiments thereof with reference to the attached drawings in which.

DESCRIPTION OF THE PREFERRED EMBODIMENTS

Figure 1:
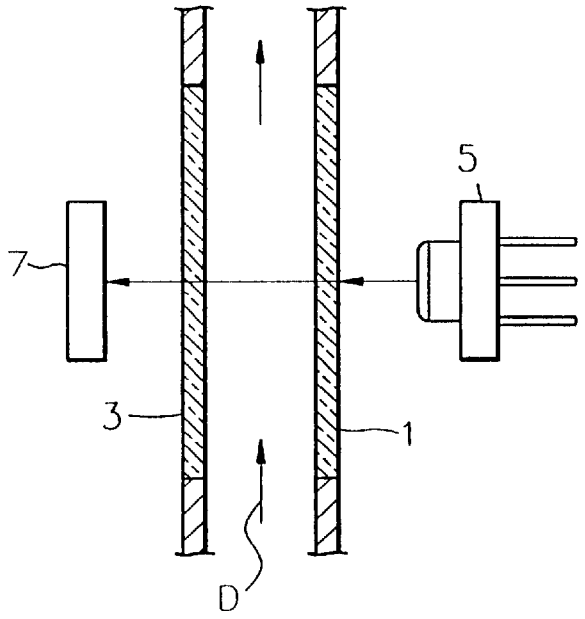
FIG.1 (PRIOR ART)
FIG. 1 is a sectional view illustrating a conventional device for measuring the concentration of a developer liquid for a liquid-type printer.
Figure 2:
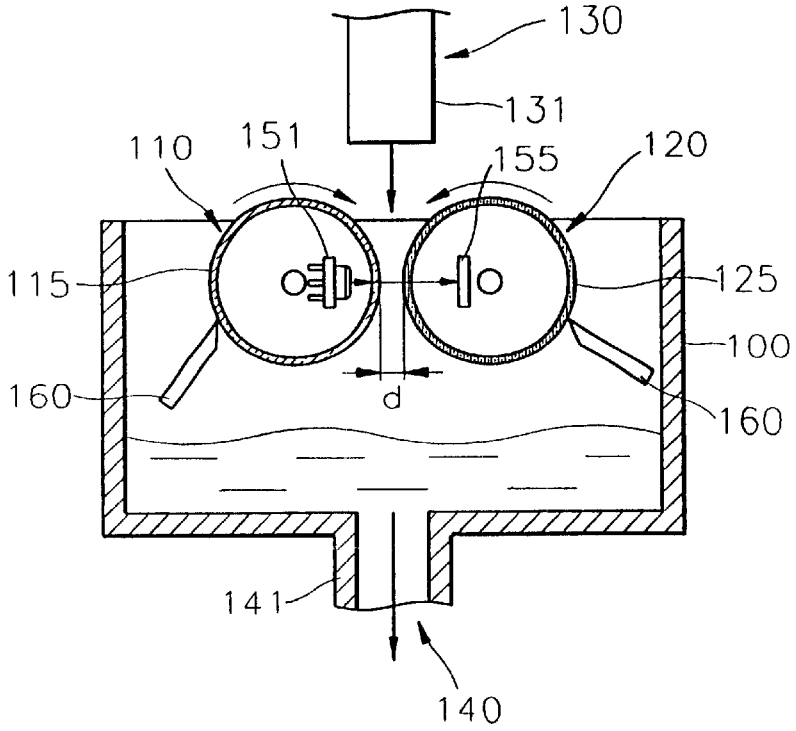
FIG. 2 is a partial sectional view illustrating a device for measuring the concentration of a developer liquid for a liquid-type printer according to a preferred embodiment of the present invention.

Referring to FIG. 2, a device for measuring the concentration of a developer liquid according to a preferred embodiment of the present invention includes a container 100 having a discharge portion 140 through which a developer liquid is discharged, first and second rotary members 110 and 120, which are rotatably installed with a predetermined interval in the container 100, a supply portion 130 for supplying the developer liquid between the first and second rotary members 110 and 120, and a concentration detector for measuring the concentration of the developer liquid.

The concentration measuring device further includes cleaning members 160 such as blades, each of which is installed in contact with the surface of the first and second rotary members 110 and 120. The cleaning members 160 wipe the developer liquid off the surface of the first and second rotary members 110 and 120 as the first and second rotary members 110 and 120 rotate, thus preventing sticking of the toner particles to the surface of the first and second rotary members 110 and 120.

Preferably, the first and second rotary members 110 and 120 are a roller type, and are installed so that the space therebetween is maintained. Here, a space d between the first and second rotary members 110 and 120, and particularly, at a location where the concentration detector is disposed, is not greater than approximately 0.1 mm. Thus, the flow thickness of the developer liquid, which flows from the supply portion 130 through the space d between the first and second rotary members 110 and 120, becomes approximately 0.1 mm or less. Thus, the concentration of developer liquids having a color of yellow, magenta and cyan can be measured, as well as a black developer liquid having a relatively low transmittance compared to other colors.

The first and second rotary members 110 and 120 can be separately rotated by different drivers (not shown) or can be rotated by one driver (not shown). Preferably, the first and second rotary members 110 and 120 are rotated at a constant speed during measurement of the concentration of developer liquid. In order to facilitate flow of the developer liquid between the first and second rotary members 110 and 120, and to control flow of the developer liquid to be constant, the first and second rotary members 110 and 120 may be rotated in the same direction as the flow of developer liquid. Alternatively, the first and second rotary members 110 and 120 may be stopped during the measurement of concentration, and then rotated by a predetermined number of turns after the concentration measurement.

In the present embodiment, at least a part of the first and second rotary members 110 and 120 are formed of transparent substrates 115 and 125 which correspond to each other. Preferably, the transparent substrates 115 and 125 are formed in a cylindrical shape to allow a continuous light transmission during rotation of the first and second rotary members 110 and 120.

The supply portion 130, which is installed above the container 100, supplies the developer liquid between the first and second rotary members 110 and 120. The supply portion 130 may be designed to be selectively opened for the concentration measurement. For the configuration, the supply portion 130 includes a supply tube 131 which diverges from a developer liquid pathway 25 (see FIG. 3), reaching slightly over the container 100, and a first valve 135 (see FIG. 3) installed at the supply tube 131, which is used to selectively open the supply portion 130. The first valve 135 is normally closed and is opened only when there is a need to measure the concentration of developer liquid.

Also, the discharge portion 140 of the container 100 has a discharge tube 141 which is connected between the base of the container 100 and the developer liquid pathway. The discharge portion 140 may further comprise a second valve 145 (see FIG. 3) installed at the discharge tube 141, which is selectively opened or closed. The second valve 145 and the first valve 135 may be opened or closed simultaneously or with a predetermined interval.

The concentration detector includes a light source 151 installed in the first rotary member 110, which emits light to the second rotary member 120, and a photodetector 155 which is installed in the second rotary member 120, facing the light source 151. The photodetector 155 detects the light transmitted through the developer liquid, which flows along a predetermined space between the first and second rotary members 110 and 120, after being emitted from the light source 151.

In the concentration measuring device for a liquid-type printer, the supply portion 130, which is diverged from the developer liquid pathway, selectively supplies the developer liquid into the space between the first and second rotary members 110 and 120. After the concentration measurement, the developer liquid is fed back into the developer liquid pathway through the discharge portion 140 that is conducted to the developer liquid pathway.

Figure 3:
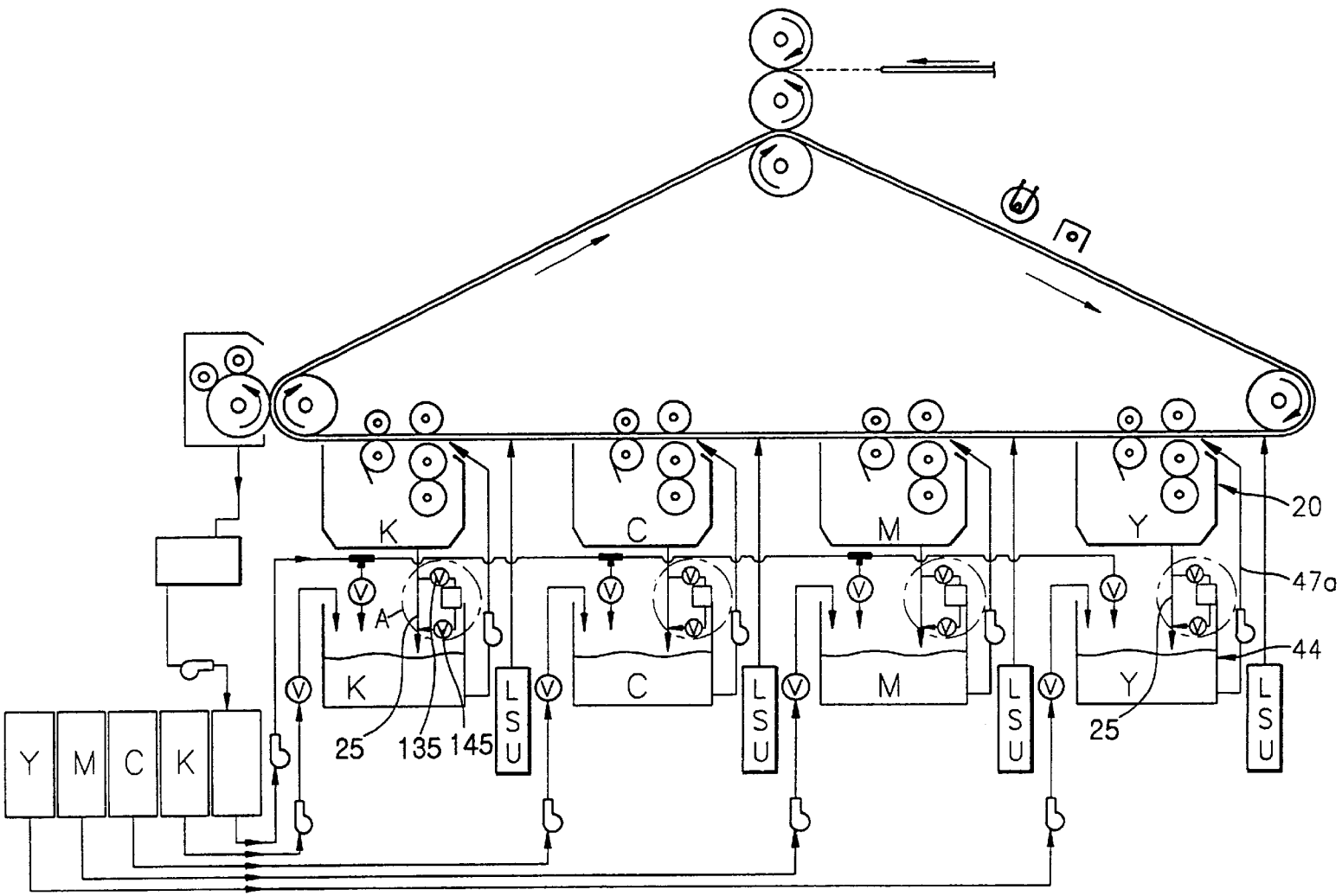
FIG. 3 is a diagram illustrating the structure of a liquid-type printer adopting a concentration measuring device according to the present invention.

As shown in FIG. 3, the concentration measuring device according to the embodiment of the present invention is disposed on the developer liquid pathway 25 between a developing unit 20 and a circulation tank 44 (see the part A of FIG. 3). That is, the concentration measuring device takes a developer liquid from the developer liquid pathway 25 to measure the concentration of the developer liquid, and feeds back the developer liquid into the developer liquid pathway after the concentration measurement.

Alternatively, the concentration measuring device may be installed on a developer liquid supply pathway 47*a*. In such a case, the supply tube 131 and the discharge tube 141 are formed as parts of the developer liquid supply path 47*a*, and the concentration of the developer unit is intermittently measured.

In the operation of the concentration measuring device for a liquid-type printer according to the present invention, the concentration measuring device according to the present invention is intermittently operated in a warm-up mode, a standby mode or a print mode of the printer. When the first valve 135 of the supply tube 131 is opened to measure the concentration of a developer liquid, the first and second rotary members 110 and 120, which are spaced a predetermined distance from each other, rotate at a constant speed and the developer liquid having a predetermined flow thickness flows into the space d between the first and second rotary members 110 and 120. If the first and second rotary members 110 and 120 rotate at a constant speed, then the flow thickness of the developer liquid in the space therebetween is constantly maintained. The second valve 145 of the discharge tube 141 is opened simultaneously or with a predetermined interval with respect to the first valve 135.

The light emitted from the light source 151 transmits through the developer liquid, and is then received by the photodetector 155. Here, the light transmittance is determined by the flow thickness and concentration of developer liquid. The measured light transmittance is compared to light transmittance data which are tabulated in a look-up table with respect to the flow thickness and the concentration of developer liquid.

Also, the developer liquid stuck to the surface of the first and second rotary members 110 and 120 is wiped off by the cleaning members 160 with the rotation of the first and second rotary members 110 and 120. Thus, the contamination of the first and second rotary members 110 and 120 by toner particles is prevented.

The concentration measurement is carried out for a predetermined period of time. When the concentration measurement is completed, the first and second valves 135 and 145 are closed, and the operation of the concentration measuring device is stopped. The concentration measuring device according to the present invention repeats the above measurement operation with a predetermined interval.

Figure 4:
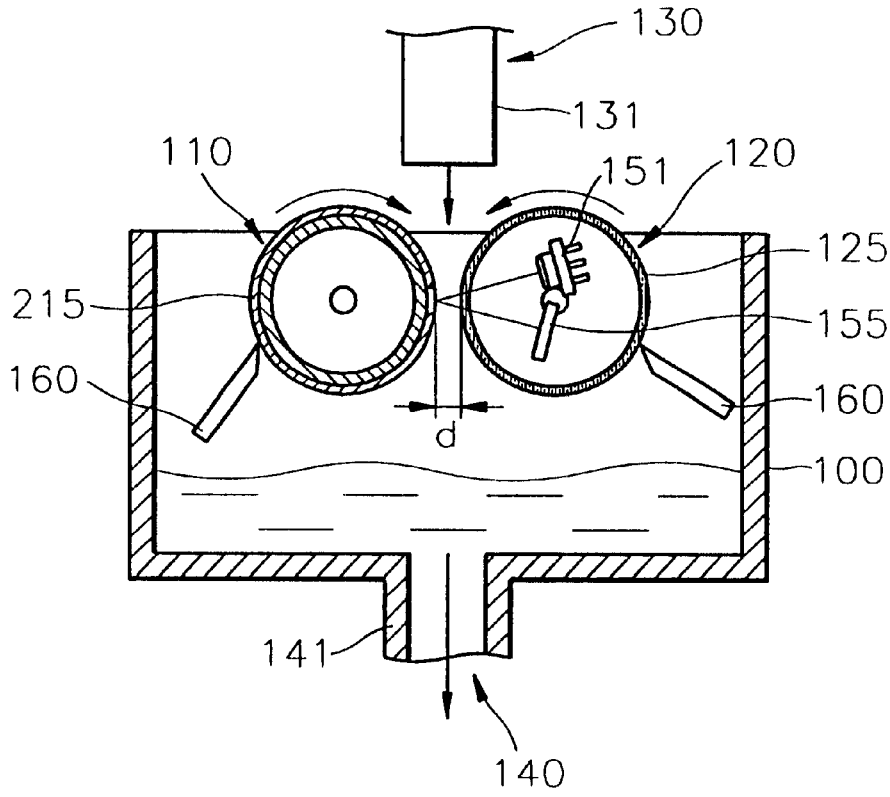
FIG. 4 is a partial sectional view illustrating another embodiment of a concentration measuring device of a liquid-type printer according to the present invention.

FIG. 4 is a partial sectional view of another embodiment of a concentration measuring device according to the present invention. The reference numerals which are the same as those of FIGS. 2 and 3 represent the same elements. In the present embodiment, the concentration detector includes a reflection member 215 which is formed at at least a part of the first rotary member 110, and at least a part of the second rotary member 120 is formed of a transparent substrate 125, such that the reflection member 215 and the transparent substrate 125 face each other. Both the light source 151 and the photodetector 155 are installed in the second rotary member 120. The reflection member 215 may be coated on the surface of the first rotary member 110.

The light emitted from the light source 151 sequentially passes through the transparent member 125 and the developer liquid flowing along the space d between the first and second rotary members 110 and 120. Then, the light which has passed through the developer liquid is reflected by the reflection member 215, and is then received by the photodetector 155 through the developer liquid and the transparent member 125 in sequence.

The light emitted from the light source 151 is received by the photodetector 155 after passing through the developer liquid twice, and thus the space d between the first and second rotary members 110 and 120, and particularly, a portion of the space d through which the light passes, is approximately 0.05 mm or less.

Since the light emitted from light source 151 is detected by the photodetector 155 after passing through the developer liquid twice, assuming that the flow thickness and concentration of developer liquid are the same as in the above embodiment, the amount of light detected by the photodetector 155 becomes half the amount of light detected in the above embodiment.

The light emitted from the light source 151 is incident onto the developer liquid at a predetermined angle, and is again incident onto the developer liquid at a predetermined angle after being reflected by the reflection member 215. A light path between the first and second rotary members 110 and 120 varies depending on the arrangement of the light source 151 and the photodetector 155 in the second rotary member 120. In the present embodiment, the concentration of the developer liquid is determined based on the light path, not the space d between the first and second rotary members 110 and 120. A signal detected by the photodetector 155 is compared with the data of the lookup table, and thus the concentration of the developer liquid can be accurately measured.

In the concentration measuring device for a liquid-type printer according to the present invention, the space d between the first and second rotary members can be adjusted to be smaller, so that the concentration of a developer liquid having a low light transmittance can be also measured. Also, the developer liquid can be rapidly supplied by rotating the first and second rotary members in the flow direction of the developer liquid, thus maintaining a constant flow rate of the developer liquid. In addition, due to the cleaning members installed in contact with the first and second rotary members, toner particles stuck to the surface of the first and second rotary members can be removed, thereby preventing a decrease in light transmittance.

While this invention has been particularly shown and described with reference to preferred embodiments thereof, it will be understood by those skilled in the art that various changes in form and details may be made therein without departing from the spirit and scope of the invention as defined by the appended claims.

What is claimed is:

1. A device for measuring the concentration of developer liquid for a liquid-type printer, comprising:

a container having a discharge portion;

first and second rotary members rotatably installed in the container with a predetermined space therebetween;

a supply portion for supplying the developer liquid containing toner particles and liquid carrier into the space between the first and second rotary members; and a concentration detector for detecting the concentration of the developer liquid by emitting light onto the developer liquid flowing along the space between the first and second rotary members, and receiving the light passed through the developer liquid, wherein the concentration detector comprises:

a reflection member formed at at least a part of the surface of the first rotary member;

a transparent member formed at at least a part of the second rotary member, corresponding to the reflection member;

a light source installed in the second rotary member, for emitting light toward the transparent member; and a photodetector installed near the light source in the second rotary member, for receiving the light reflected by the reflection member, which has been emitted from the light source and passed through the developer liquid flowing along the space between the first and second rotary members.

* * * * *